US009242392B2

(12) United States Patent
Shimizu et al.

(10) Patent No.: US 9,242,392 B2
(45) Date of Patent: Jan. 26, 2016

(54) REFILL CASE

(75) Inventors: Toshio Shimizu, Tokyo (JP); Shinpei Sugihara, Tokyo (JP)

(73) Assignee: MAX CO., LTD., Tokyo (JP)

( * ) Notice: Subject to any disclaimer, the term of this patent is extended or adjusted under 35 U.S.C. 154(b) by 1045 days.

(21) Appl. No.: 12/869,062

(22) Filed: Aug. 26, 2010

(65) Prior Publication Data

US 2011/0089216 A1 Apr. 21, 2011

(30) Foreign Application Priority Data

Oct. 19, 2009 (JP) ..... 2009-240010

(51) Int. Cl.
*B25C 5/16* (2006.01)
*B27F 7/38* (2006.01)

(52) U.S. Cl.
CPC ..... *B27F 7/38* (2013.01)

(58) Field of Classification Search
CPC ..... B25C 5/16
USPC ..... 227/8, 120, 131, 136, 129
See application file for complete search history.

(56) References Cited

U.S. PATENT DOCUMENTS

| | | | | |
|---|---|---|---|---|
| 6,899,258 | B2 * | 5/2005 | Haramiishi | 227/2 |
| 2006/0144890 | A1 * | 7/2006 | Haramiishi et al. | 227/120 |
| 2008/0083805 | A1 | 4/2008 | Haramiishi et al. | |

* cited by examiner

*Primary Examiner* — Nathaniel Chukwurah
(74) *Attorney, Agent, or Firm* — Drinker Biddle & Reath LLP

(57) ABSTRACT

A refill case is provided with: an accommodating part (2) for accommodating staple-sheets (1); a staple pressing member (4) for pressing a top of the staple-sheets (1); locking saw-toothed portions (6*a*, 6*b*) having saw-toothed shapes; and return-preventing claws (5) formed ends of the staple pressing member (4) and engaged with the locking saw-toothed portions. A phase of the saw-toothed shape of the right locking saw-toothed portion is shifted from a phase of the saw-toothed shape of the left locking saw-toothed portion.

4 Claims, 7 Drawing Sheets

REFILL CASE

BACKGROUND OF THE INVENTION

1. Field of the Invention

The present invention relates to a refill case in which staples for stapling paper sheets are accommodated in straight states before formation.

2. Related Art

An electric stapler is so constituted as to be capable of attaching and detaching a staple cartridge. The staple cartridge is so constituted as to be capable of attaching and detaching a refill case in which staple-sheets, each of which is formed by connecting straight staple members with an adhesive in a sheet shape, are accommodated in a stacking manner. The refill case includes a staple pressing member which is arranged inside an accommodating part and presses a top of the accommodated staple-sheets, and return-preventing claws formed at left and right ends of the staple pressing member. These return-preventing claws are provided so as to be capable of locking in locking saw-toothed portions (return-preventing grooves), each having a saw-toothed cross section, which are formed in left and right inner walls of the accommodating part and extending along a stacking direction of the staple-sheets (Patent Document 1).

To the contrary, the staple cartridge includes a feeding path which is connected to a leading-out port from which the lowermost staple-sheet in the accommodating part of the refill case is led out, and a feeding means which leads out the lowermost staple-sheet in turn to the feeding path and feeds the led-out staple-sheet to a drive-out part side. In the feeding means, a feeding pawl is formed obliquely upward. The feeding pawl is so constituted as to feed out the staple-sheet in a state locked to a groove between front and rear staples on a bottom of the lowermost staple-sheet. Accordingly, when the staple-sheet is moved in the feeding direction, the feeding pawl acts so as to stick up the staple-sheet obliquely upward [Patent Document 1] US2008/0083805

However, in a device which adopts, as a feeding mechanism for feeding a staple-sheet to a drive-out part, such the structure that a feeding pawl is arranged obliquely to the staple-sheet, a leading end of a feeding pawl is engaged with a groove between adjacent staple members, and the feeding pawl feeds the staple-sheet so as to stick up the staple-sheet obliquely upward so that the leading end is disengaged, there is no problem in case that the number of the staple-sheets is large and the whole weight of the staple-sheets is heavy. However, for example, in case that only the last one sheet remains, when this staple-sheet is tried to be fed, there is possibility that the staple-sheet floats when stuck up by the feeding pawl and a return-preventing claw of a staple pressing member which presses the staple-sheets unlocks from a return-preventing groove. The unlocked return-preventing claw floats and engages with a peak of a return-preventing groove located immediately above the return-preventing groove. The floating amount of the staple pressing member at this time corresponds to the distance between the adjacent teeth, that is, a pitch. Therefore, there is fear that the feeding paw might disengage from the floating staple-sheet and poor feeding might be produced.

Further, when the refill case is conveyed, the return-preventing claw is liable to unlock from the locking saw-toothed portion due to large vibration. Further, in case that the return-preventing claw has unlocked, since the staple-sheet floats greatly, there is possibility that the adhesive bonding the staple members peels off at a part of the staple-sheet, the staple-sheet breaks and the connected staple members are separated. Further, also when the stapler is operated or an attaching table to which the stapler is attached moves, there is possibility that the vibration is produced in the refill case and the similar disadvantage is produced.

In order to solve these problems, it is thought to make a pitch between the teeth of the return-preventing groove small. However, since the staple-sheet is considerably thin, it is necessary to make the pitch between the teeth of the locking saw-toothed portion smaller than the thickness of the staple-sheet. In case that the refill case is formed of synthetic resin, since there is a limit in forming, it's not to say that the above pitch can be freely made small. There is a limit in making the pitch small.

SUMMARY OF THE INVENTION

One or more embodiments of the invention provide a refill case which can make a moving amount of a staple pressing member even when the staple pressing member unlocks from return-preventing groove smaller than a pitch between teeth of return-preventing groove.

In accordance with a first aspect of the embodiments, a refill case is provided with: an accommodating part (2) in which staple-sheets (1), each of which is formed by connecting straight staple members in a sheet shape, are stacked and accommodated; a staple pressing member (4) which is arranged inside the accommodating part (2) and configured to press a top of the staple-sheets (1) in the accommodating part; a right locking saw-toothed portion (6*a*, 6*b*) formed in a right inner wall (2*b*) of the accommodating part (2) and having a saw-toothed shape with a plurality of peaks (35, 35*a*, 35*b*) and a plurality of troughs (37) alternatively arranged with each other along a stacking direction of the staple-sheets (1); a left locking saw-toothed portion (6*a*, 6*b*) formed in a left inner wall (2*b*) of the accommodating part (2) and having a saw-toothed shape with a plurality of peaks (35, 35*a*, 35*b*) and a plurality of troughs (37) alternatively arranged with each other along the stacking direction; a right return-preventing claw (5) formed at a right end of the staple pressing member (4) and configured to engage with the right locking saw-toothed portion; and a left return-preventing claw (5) formed at a left end of the staple pressing member (4) and configured to engage with the left locking saw-toothed portion. The right return-preventing claw positions in the same position in the stacking direction with the left return preventing claw. A phase of the saw-toothed shape of the right locking saw-toothed portion is shifted from a phase of the saw-toothed shape of the left locking saw-toothed portion. The phase of the saw-toothed shape of the right locking saw-toothed portion may be shifted by ½ pitches from the phase of the saw-toothed shape of the left locking saw-toothed portion.

According to the above structure of the first aspect, the locking saw-toothed portions each having a saw-toothed cross section are formed in the right and left inner walls of the accommodating part for the staple-sheets along a stacking direction of the staple-sheets, the return-preventing claws are formed at both ends of the staple pressing member in a bilaterally symmetric manner, which can engage with the locking saw-toothed portions, and the phases of the right and left locking saw-toothed portions are shifted with each other. Therefore, when one claw of the staple pressing member unlocks from a peak of one corresponding locking saw-toothed portion, the other claw locks to a peak of the other locking saw-toothed portion. Since the peak of the locking saw-toothed portion from the claw has unlocked is shifted from the peak of the locking saw-toothed portion to which the claw has newly locked, the staple pressing member also moves by only a shifted amount. Thus, even in case that the interval between the peaks is the same in the locking saw-toothed portions on the both sides, the moving amount of the staple pressing member can be suppressed to the shifted amount. Accordingly, in case that the refill case is formed of synthetic resin, even in case that the formation is difficult because the pitch of the locking saw-toothed portion is so small as to be beyond a forming limit, it is possible to suppress the moving amount of the staple pressing member to the shifted amount. Therefore, it is possible to prevent the staple-sheets from floating and to prevent the occurrence of poor feeding.

In accordance with a second aspect of the embodiments, a refill case is provided with: an accommodating part (2) in which staple-sheets (1), each of which is formed by connecting straight staple members in a sheet shape, are stacked and accommodated; a staple pressing member (4) which is arranged inside the accommodating part (2) and configured to press a top of the staple-sheets (1) in the accommodating part; a right locking saw-toothed portion (6*a*, 6*b*) formed in a right inner wall (2*b*) of the accommodating part (2) and having a saw-toothed shape with a plurality of peaks (35, 35*a*, 35*b*) and a plurality of troughs (37) alternatively arranged with each other along a stacking direction of the staple-sheets (1); a left locking saw-toothed portion (6*a*, 6*b*) formed in a left inner wall (2*b*) of the accommodating part (2) and having a saw-toothed shape with a plurality of peaks (35, 35*a*, 35*b*) and a plurality of troughs (37) alternatively arranged with each other along the stacking direction; a right return-preventing claw (5) formed at a right end of the staple pressing member (4) and configured to engage with the right locking saw-toothed portion; and a left return-preventing claw (5) formed at a left end of the staple pressing member (4) and configured to engage with the left locking saw-toothed portion. A phase of the saw-toothed shape of the right locking saw-toothed portion is the same with a phase of the saw-toothed shape of the left locking saw-toothed portion. The right locking saw-toothed portion is formed in a position shifted from the left locking saw-toothed portion in the stacking direction. The right locking saw-toothed portion may be formed in a position shifted by ½ pitches of said saw-toothed shape in the stacking direction from the left locking saw-toothed portion.

According to the above structure of the second aspect of the embodiments, the right and left locking saw-toothed portions are arranged in the same positions of the right and left inner walls in the same phases, and the right and left return-preventing claws are formed so as to be shifted with each other. Therefore, the advantage similar to that in the first aspect can be obtained.

Other aspects and advantages of the invention will be apparent from the following description and the appended claims.

DETAILED DESCRIPTION OF THE EXEMPLARY EMBODIMENTS

Figure 1:
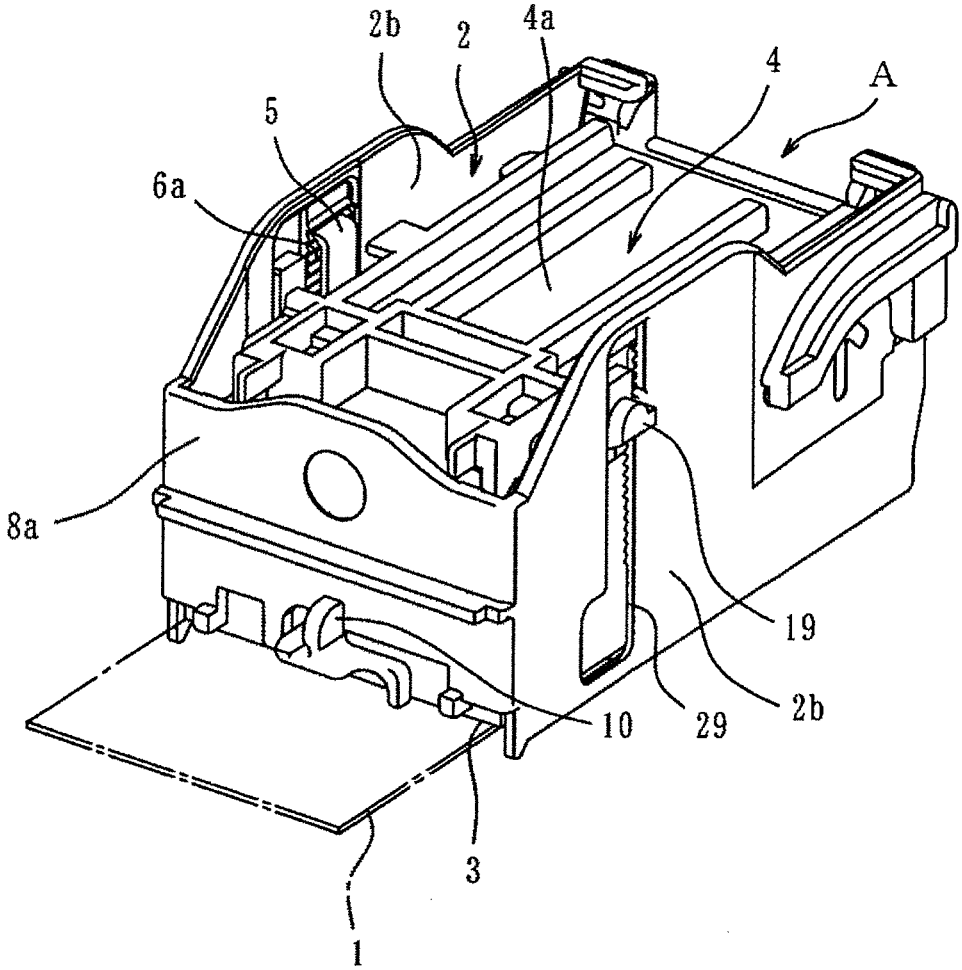
FIG. 1 is a perspective view of a refill case according to an exemplary embodiment.
Figure 2:
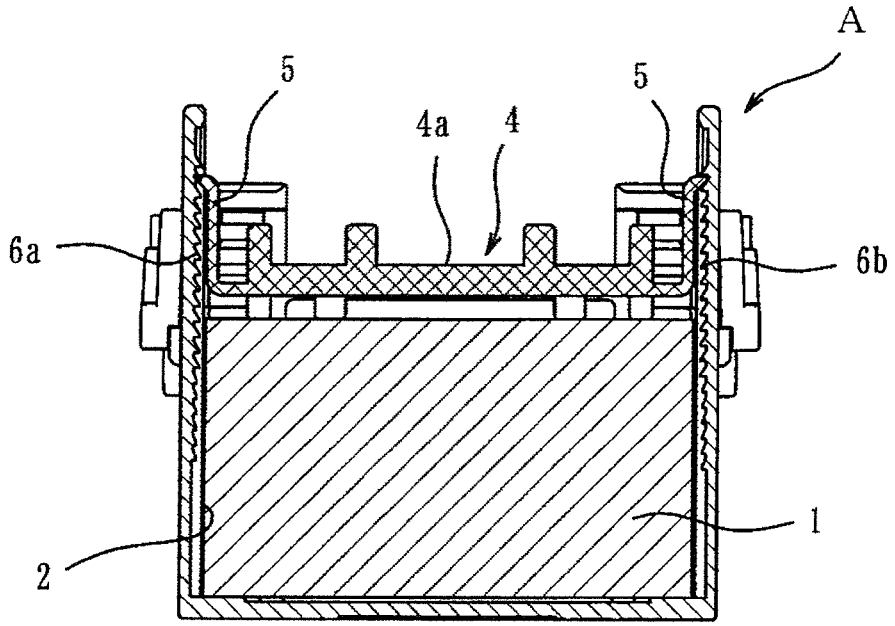
FIG. 2 is a longitudinal sectional view of the refill case.
Figure 3:
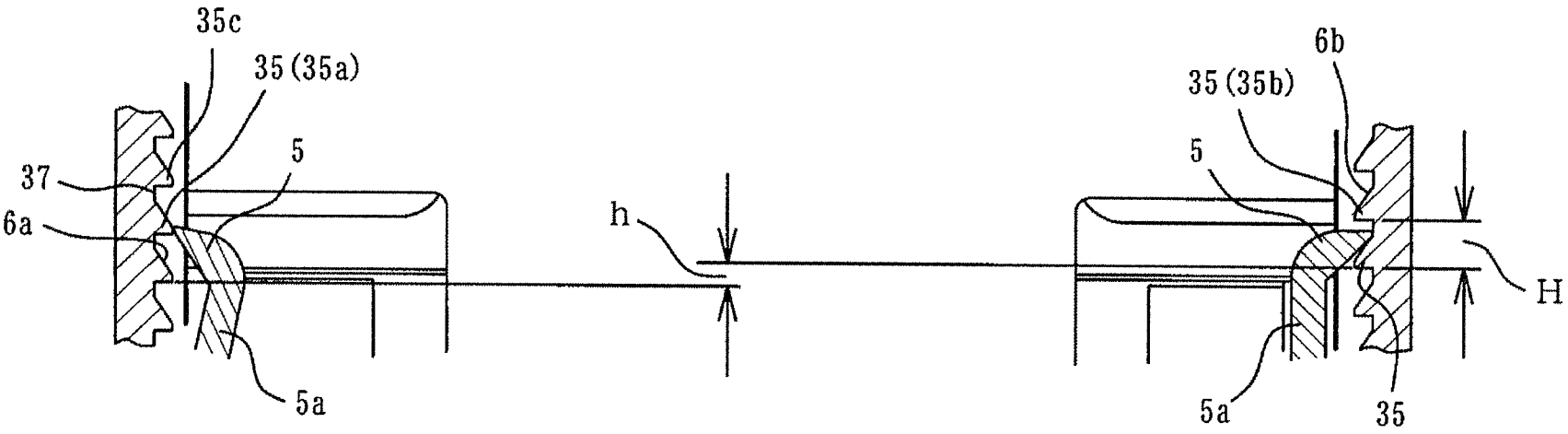
FIG. 3 is an enlarged view showing a phase of a locking saw-toothed portion.

FIG. 1 is a perspective view of a refill case made of synthetic resin, and FIG. 2 is a longitudinal sectional view of the refill case. In the figures, a reference character A represents the refill case made of synthetic resin. The refill case A includes an accommodating part 2 in which staple-sheets 1 are accommodated in a stacking manner, and a staple pressing member 4 made of synthetic resin, which is arranged at a top of the staple-sheets 1 accommodated in the accommodating part 2. The staple pressing member 4 is used in order to prevent the accommodated staple-sheets 1 from getting out of an upper opening portion of the refill case A due to vibration in the conveying time or in the stapling time. On both sides of a plate part 4*a* having the substantially same size as the size of the staple-sheet 1, there are formed standing pieces 5*a* each having a return-preventing claw 5 at its leading end, and projections 19 protruding laterally. The return-preventing claws 5 are formed in a bilaterally symmetric manner. As shown in FIG. 3, the return-preventing claw 5 is formed so as to protrude from the leading end of the standing piece 5*a* to the outside.

The staple-sheet 1 is formed by connecting straight staple members in a sheet-shape with an adhesive. The staple member is formed in U-shape inside an electric stapler C described later and thereafter driven out.

In a front wall 8*a* of the accommodating part 2 of the refill case A, there is formed a leading-out port 3 from which the lowermost staple-sheet 1 is led out. Further, at a bottom of the refill case A, an opening part (not shown) is formed, from which a lower surface of a lowermost staple-sheet is exposed. In both sidewalls 2*b* of the accommodating part 2, opening grooves 29 are formed in the up-down direction. In the inner walls of the left and right sidewalls 2*b*, locking saw-toothed portions 6*a* and 6*b* having saw-toothed shapes with a plurality of peaks and a plurality of troughs alternatively arranged with each other are formed along an up and down direction (stacking direction of staple-sheets). Though a size of the locking saw-toothed portion 6*a* is the same as that of the locking saw-toothed portion 6*b*, a phase of the locking saw-toothed portion 6*a* is shifted from a phase of the locking saw-toothed portion 6*b* by ½ pitches as described later. To the contrary, the left and right return-preventing claws 5 are arranged in the same height positions of the left and right sidewalls 2*b*.

In the accommodating part 2, the plural staple-sheets 1 are accommodated, being stacked in multistage. At the top of the staple-sheets 1, the staple pressing member 4 is arranged, which presses the staple-sheets 1 from the upside so that the staple-sheets 1 are not shaky. The projections 19 of the staple pressing member 4 are protruded outward from the opening grooves 29 formed on the both sides of the accommodating part 2. Further, the return-preventing claws 5 of the staple pressing member 4, when the staple pressing member 4 descends, get over the locking saw-toothed portions 6*a*, 6*b* formed in the inner surface of the accommodating part 2; and when the staple pressing member attempts to ascend, lock to the locking saw-toothed portions 6*a*, 6*b*, thereby to prevent the staple pressing member from floating.

Figure 5:
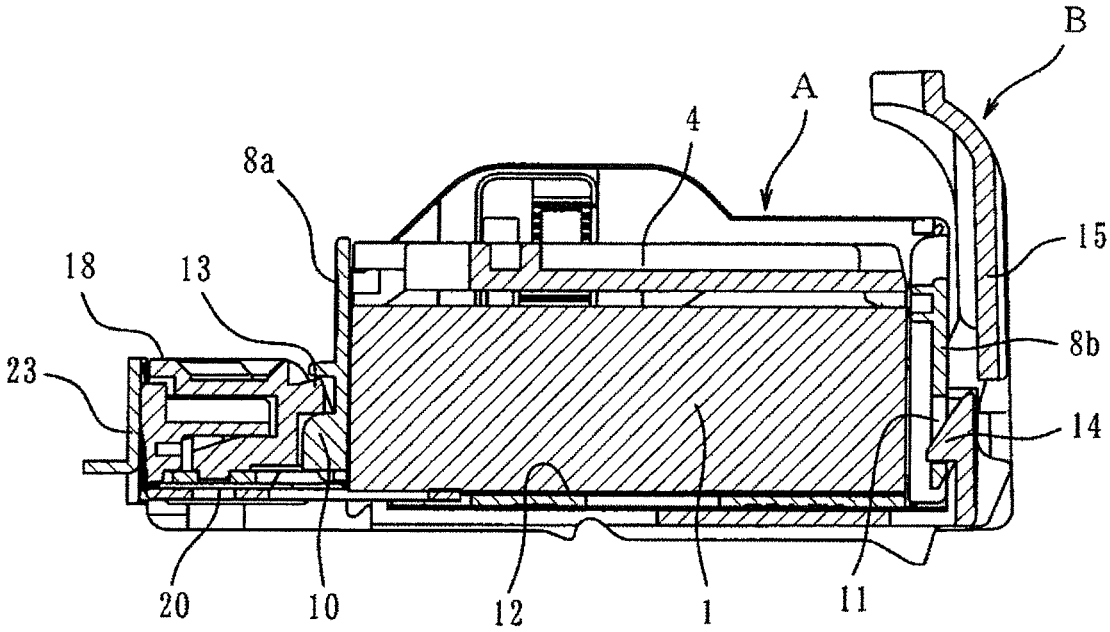
FIG. 5 is a sectional view showing a state where the refill case is attached to the staple cartridge.

As shown in FIG. 5, at the front wall 8*a* and at a rear wall 8*b* of the refill case A, an engaging part 10 and a locking hole 11 are formed respectively.

Figure 4:
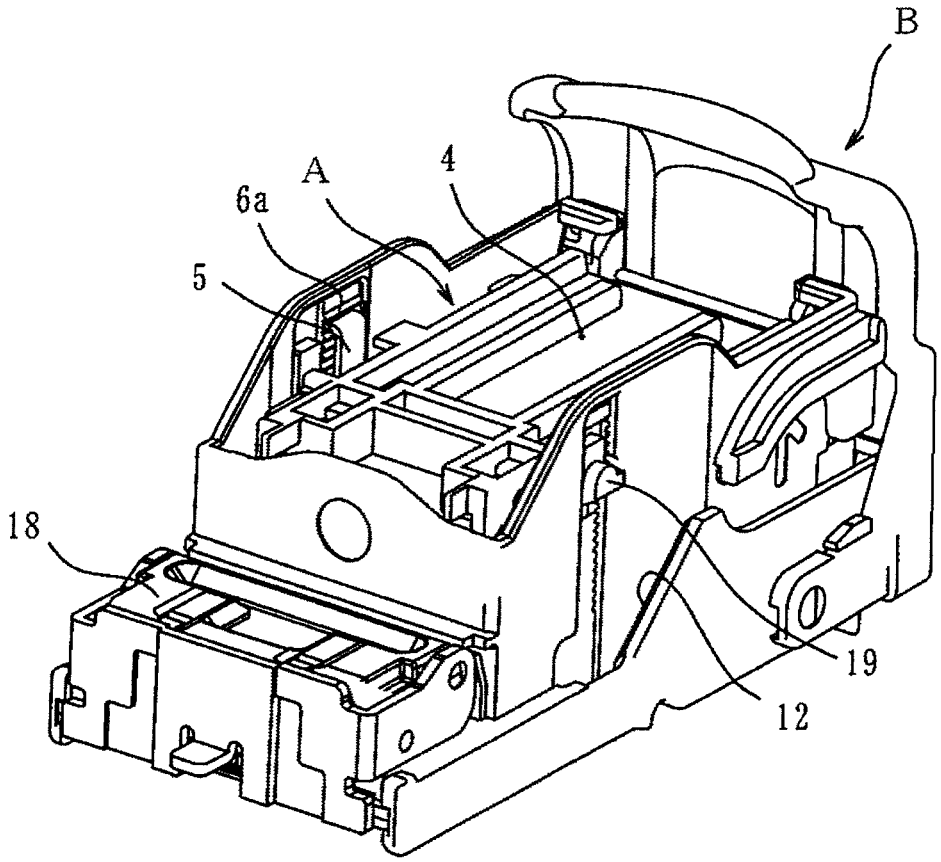
FIG. 4 is a perspective view showing a state where the refill case is attached to a staple cartridge.

Next, in FIGS. 4 and 5, a reference character B is a staple cartridge for attaching and detaching the refill case A, in which an attachment part 12 for attaching the refill case A is formed. At the front upper portion of the attachment part 12, a pressing part 13 for the refill case A is formed being protruded inward. At the back portion of the attachment part 12, a locking piece 15 having a locking jaw 14 is formed downward.

On the front side of the attachment part 12, a staple guide part 18 is formed protrusively. At the lower portion of the staple guide part 18, a feeding path 20 for the staple-sheet 1 is formed. A front end of the feeding path 20 opens to a drive-out part 23 formed penetratingly in the up-down direction.

Under the above constitution, in case that the refill case A is attached to the attachment part 12 of the staple cartridge B as shown in FIG. 5, first, the engaging part 10 of the front wall 8*a* of the refill case A is obliquely forward pushed into the lower portion of the pressing part 13 of the attachment part 12. Thereafter, the refill case A is downward moved rotationally around the leading end of the engaging part 10, and the locking jaw 14 of the locking piece 15 of the attachment part 12 is locked into the locking hole 11 of the refill case A.

Figure 6:
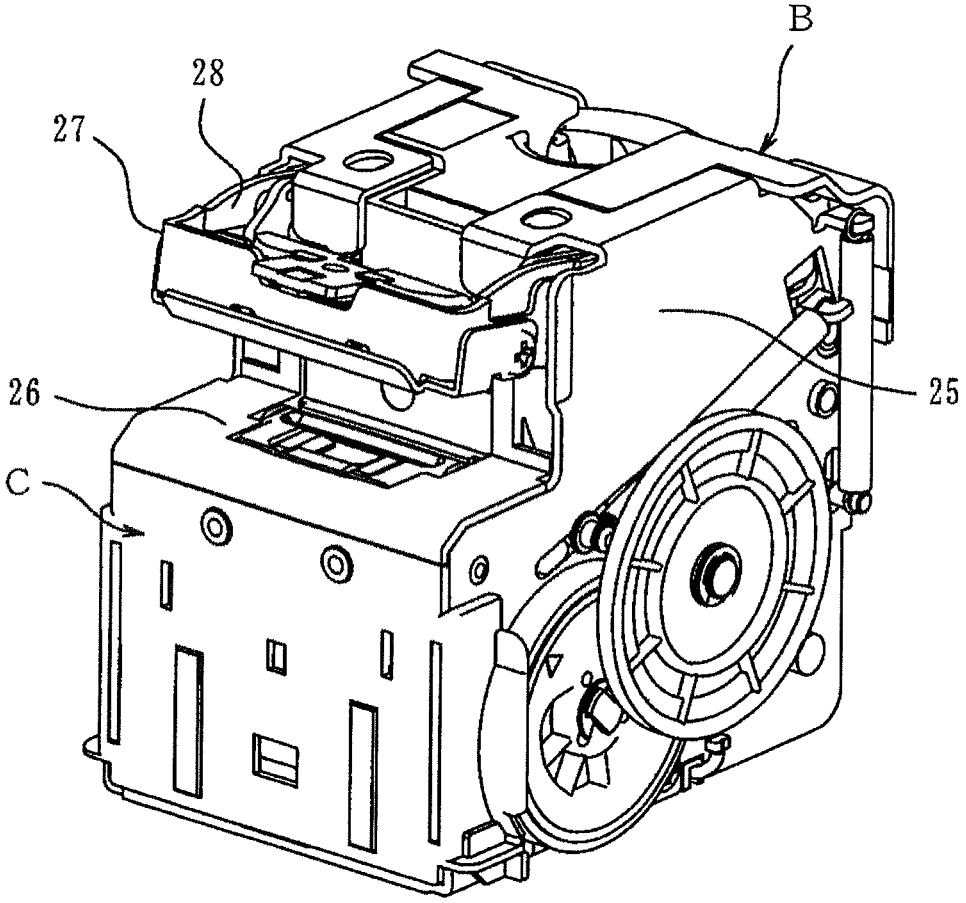
FIG. 6 is a perspective view of an electric stapler.
Figure 7:
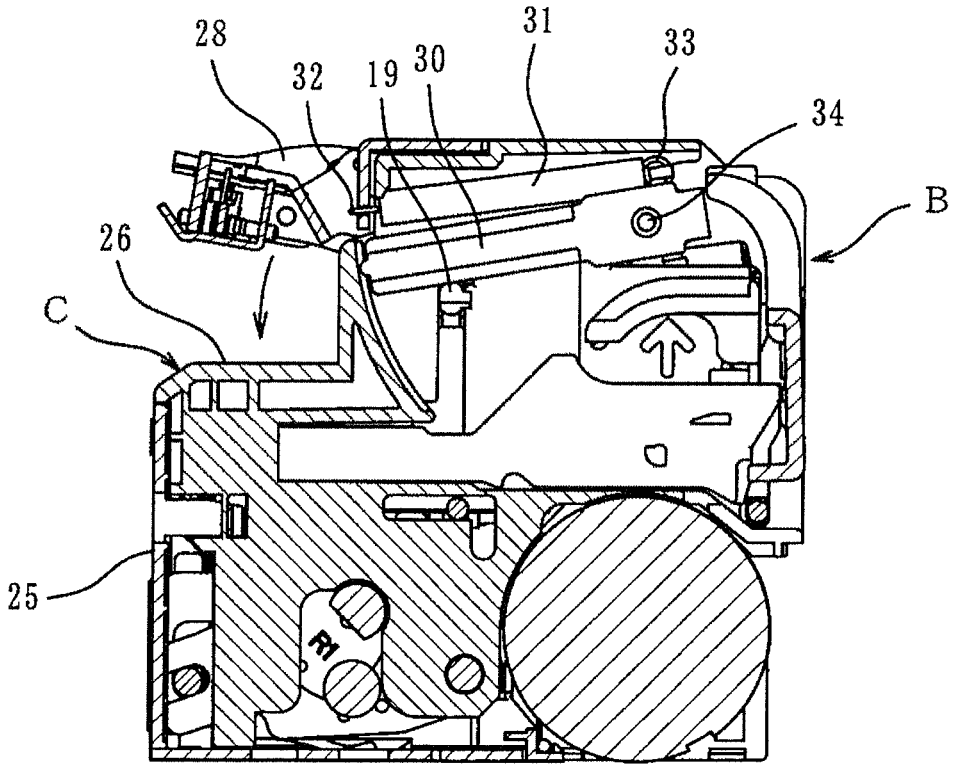
FIG. 7 is a sectional view of the above electric stapler in a state where the staple cartridge is attached.

Next, the staple cartridge B to which the refill case A has been attached is constituted so as to be detachably attached to the electric stapler C as shown in FIGS. 6 and 7. The electric stapler C is mounted on a paper handing device used as a paper finisher provided in a back stage of an image forming apparatus such as a copying machine or a printer. For a stapler body 25, a stapling table 26 is provided; below the stapling table 26, a not-shown staple forming and driving part is provided; and above the stapling table 26, a clincher drive part 27 is provided swingably in the up and down direction.

The forming and driving part is a section which forms staples fed out sequentially from the staple cartridge B and drives out the formed staple, in which there is provided a forming and driving mechanism which includes a forming plate for forming a staple in the U-shape and a driver for driving out the formed staple. The clincher drive part 27 includes, at a leading end of a drive link 28 provided swingably for the stapler body 25, a movable clincher which bends leg portions of the staple driven out by the driver and penetrating the paper sheets. Since both the forming and driving mechanism and the clincher drive part are known, the description of them is omitted.

Further, on both sides of the back portion of the electric stapler C, push bars 30 are provided. The back portion of the push bar 30 is attached pivotally by a pivot 34 provided for the stapler body 25. Above the push bar 30, an extension spring 31 is arranged, which has a front end 32 locked to the staple cartridge B and a back end 33 locked to a back end upper portion of the push bar 30. Accordingly, by the action of the extension spring 31, the front end of the push bar 30 is always energized so as to move downward.

Under the above constitution, when the staple cartridge B is inserted from the backside of the stapler body 25 into the stapler body 25, the projection 19 of the staple pressing member 4 of the refill case engages with the lower surface of the push bar 30 as shown in FIG. 7. When the staple cartridge B continues to be inserted and attached in the predetermined position, the projection 19 is pushed up to the uppermost portion of the push bar 30. Accordingly, since the staple pressing member 4 is pressed downward by the push bar 30, the staple-sheets 1 in the refill case A is held down by the staple pressing member 4.

When the paper sheets are stapled, the lowermost staple-sheet 1 in the refill case A is previously fed to the feeding path 20 in the staple cartridge B shown in FIG. 5 by a feeding means (not shown), and formed in the U-shape by the forming plate, and thereafter a leading staple is supplied to the drive-out part 23. At this time, the paper sheets are prepared and placed on the stapling table 26 in FIG. 6, and a switch is turned on. Then, the drive link 28 swings downward and clamps the paper sheets between the stapling table 26 and the clincher drive part 27. Thereafter, the formed staple is driven out upward by the driver (simultaneously, the next staple is formed), and the driven staple penetrates the paper sheets and protrudes from the paper sheets. Next, the protruded staple portion is bent by the movable clincher along the face of the paper sheets, and stapling is completed. After the stapling has been completed, the drive link 28 returns and moves to the upper waiting position.

Since the number of the staple-sheets 1 in the staple cartridge B decreases little by little as the stapling operation is thus repeated, the position of the uppermost staple-sheet lowers. As the position of the staple-sheet lowers, the return-preventing claw 5 of the staple pressing member 4 gets over the locking saw-toothed portions 6*a*, 6*b* by the push bar 30 and moves down. Therefore, pressing of the staple-sheets 1 is secured.

The right and left locking saw-toothed portions 6*a* and 6*b* formed in the both sidewalls 2*b* of the refill case A are different from each other in phase. As shown in FIG. 3, the left and right locking saw-toothed portions 6*a* and 6*b* are out of phase with each other by ½ pitches. Namely, although the interval of a pitch (interval between peaks (teeth) or interval between troughs) H is the same in the locking saw-toothed portions 6*a* and 6*b*, phases of the saw-tooth shapes of the left and right locking saw-toothed portions 6*a* and 6*b* are shifted with each other by an interval h of ½ pitches. Therefore, the right and left return-preventing claws 5 of the staple pressing member 4 are in a state where when one return-preventing claw 5 locks to a peak (tooth) 35 of one locking saw-toothed portion 6*a*, the other return-preventing claw 5 does not lock to a peak 35 of the other locking saw-toothed portion 6.

Figure 8:
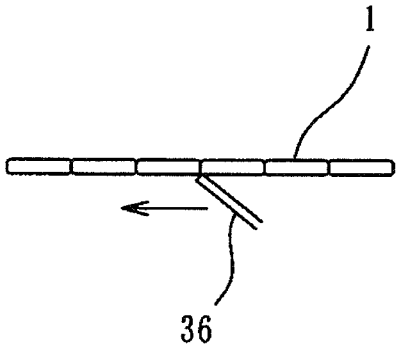
FIG. 8 is a diagram for explaining briefly feeding of a staple-sheet.

Accordingly, for example, when the last one staple-sheet remains because of any reason, since the pushing force by the push bar 30 is becoming small, there is fear that one return-preventing claw 5 might unlock from the peak 35*a* of one locking saw-toothed portion 6*a* as shown in FIG. 3. Further, when the staple-sheet 1 is fed by the feeding pawl 36 as shown in FIG. 8, since the staple-sheet 1 is stuck up, there is possibility that the staple-sheet 1 will float. If the floating amount at this time is large, there is fear that the feeding pawl 36 might unlock from the locking saw-toothed portions 6*a* and 6*b*. However, in case of the invention, if one return-preventing claw 5 unlocks from the peak 35*a* of one locking saw-toothed portion 6*a*, the other return-preventing claw 5 locks to a peak 35*b* of the other locking saw-toothed portion 6*b*. Since the peak 35*a* of the locking saw-toothed portion 6 from which one return-preventing claw has unlocked is out of phase with the peak 35*b* of the locking saw-toothed portion 6 to which the other return-preventing claw has newly locked by only ½ pitches, the staple pressing member moves by only ½ pitches. Thus, since the moving amount of the staple pressing member is suppressed by ½ pitches of the locking saw-toothed portion 6, the return-preventing claw 5 is difficult to lock from the locking saw-toothed portion 6*a*. Further, when the staple-sheet 1 is fed by the feeding pawl 36, the floating amount of the staple-sheet 1 when the staple-sheet 1 is stuck up is only the ½ pitches of the locking saw-toothed portion 6. Therefore, in the feeding time, the feeding pawl 36 is prevented from unlocking from the lower surface of the staple-sheet 1, and the staple-sheet is sent surely in the predetermined direction.

Further, even if the return-preventing claw 5 unlocks from the locking saw-toothed portion in the conveying time, since the up-down movement of the staple-sheets 1 is small because of the same reason, a phenomenon in which the staple-sheet 1 is broken is also avoided.

Further, in case that the refill case A is formed of synthetic resin, even in case that the formation is difficult because the pitch of the locking saw-toothed portion 6*a*, 6*b* is so small as to be beyond a machining limit, it is possible to suppress the moving amount of the staple pressing member to a half of the pitch of the locking saw-toothed portion 6*a*, 6*b* close to the machining limit. Therefore, it is possible to suppress the floating of the staple-sheets 1 to the minimum and to prevent effectively poor feeding from being produced.

The return-preventing claw 5 which has locked from the peak 35*a* of one locking saw-toothed portion 6*a* is located between a peak 35*c* of the locking saw-toothed portion 6 on the peak 35*a* and a trough 37.

To the contrary, as in the conventional arrangement, in case that the locking saw-toothed portions 6 are arranged so that the right and left teeth are opposed to each other and the right and left troughs are opposed to each other, if one return-preventing claw unlocks from the peak of one locking saw-toothed portion because of any reason, the return-preventing claw has an elbowroom for moving upward by one pitch. Therefore, when this staple-sheet is fed by the feeding pawl, since the floating amount of the staple-sheet stuck up by the feeding pawl is large, there is possibility that the feeding pawl unlocks from the floating staple-sheet and poor feeding is caused. Further, if the return-preventing claw unlocks from the locking saw-toothed portion 6 in the conveying time of the refill case, since the vibration is great, there is also possible that the adhesive which bonds staple members to each other will peel off at a part of the staple-sheet, the staple-sheet will be broken, and the staple members will be disconnected from each other.

Further, in place of forming the right and left locking saw-toothed portions so that the phases of them are shifted with each other by ½ pitches and forming the right and left return-preventing claws in the same positions, the right and left locking saw-toothed portions may be formed to have the same phase with each other and the right and left return-preventing claws may be arranged to be shifted with each other by ½ pitches of the saw-toothed shape.

DESCRIPTION OF REFERENCE NUMERALS AND SIGNS

A Refill case
B Staple cartridge
C Electric stapler
1 Staple-sheet
2 Accommodating part
4 Staple pressing member
5 Return-preventing claw

What is claimed is:

1. A refill case comprising:

an accommodating part in which staple-sheets, each of which is formed by connecting straight staple members in a sheet shape, are stacked and accommodated;

a staple pressing member which is arranged inside the accommodating part and configured to press a top of the staple-sheets in the accommodating part;

a right locking saw-toothed portion formed in a right inner wall of the accommodating part and having a saw-toothed shape with a plurality of peaks and a plurality of troughs alternatively arranged with each other along a stacking direction of the staple-sheets;

a left locking saw-toothed portion formed in a left inner wall of the accommodating part and having a saw-toothed shape with a plurality of peaks and a plurality of troughs alternatively arranged with each other along the stacking direction;

a right return-preventing claw formed at a right end of the staple pressing member and configured to engage with the right locking saw-toothed portion; and a left return-preventing claw formed at a left end of the staple pressing member and configured to engage with the left locking saw-toothed portion, wherein the right return-preventing claw positions in the same position in the stacking direction with the left return preventing claw, and wherein a phase of the saw-toothed shape of the right locking saw-toothed portion is shifted from a phase of the saw-toothed shape of the left locking saw-toothed portion.

2. A refill case comprising:

an accommodating part in which staple-sheets, each of which is formed by connecting straight staple members in a sheet shape, are stacked and accommodated;

a staple pressing member which is arranged inside the accommodating part and configured to press a top of the staple-sheets in the accommodating part;

a right locking saw-toothed portion formed in a right inner wall of the accommodating part and having a saw-toothed shape with a plurality of peaks and a plurality of troughs alternatively arranged with each other along a stacking direction of the staple-sheets;

a left locking saw-toothed portion formed in a left inner wall of the accommodating part and having a saw-toothed shape with a plurality of peaks and a plurality of troughs alternatively arranged with each other along the stacking direction;

a right return-preventing claw formed at a right end of the staple pressing member and configured to engage with the right locking saw-toothed portion; and a left return-preventing claw formed at a left end of the staple pressing member and configured to engage with the left locking saw-toothed portion, wherein the right return-preventing claw positions in the same position in the stacking direction with the left return preventing claw, and wherein a phase of the saw-toothed shape of the right locking saw-toothed portion is Shifted by ½ pitches from a phase of the saw-toothed shape of the left locking saw-toothed portion.

3. A refill case comprising:

an accommodating part in which staple-sheets, each of which is formed by connecting straight staple members in a sheet shape, are stacked and accommodated;

a staple pressing member which is arranged inside the accommodating part and configured to press a top of the staple-sheets in the accommodating part;

a right locking saw-toothed portion formed in a right inner wall of the accommodating part and having a saw-toothed shape with a plurality of peaks and a plurality of troughs alternatively arranged with each other along a stacking direction of the staple-sheets;

a left locking saw-toothed portion formed in a left inner wall of the accommodating part and having a saw-toothed shape with a plurality of peaks and a plurality of troughs alternatively arranged with each other along the stacking direction;

a right return-preventing claw formed at a right end of the staple pressing member and configured to engage with the right locking saw-toothed portion; and a left return-preventing claw formed at a left end of the staple pressing member and configured to engage with the left locking saw-toothed portion, wherein a phase of the saw-toothed shape of the right locking saw-toothed portion is the same with a phase of the saw-toothed shape of the left locking saw-toothed portion, and wherein the right return-preventing claw is formed in a position shifted from the left return-preventing claw in the stacking direction.

4. A refill case comprising:

an accommodating part in which staple-sheets, each of which is formed by connecting straight staple members in a sheet shape, are stacked and accommodated;

a staple pressing member which is arranged inside the accommodating part and configured to press a top of the staple-sheets in the accommodating part;

a right locking saw-toothed portion formed in a right inner wall of the accommodating part and having a saw-toothed shape with a plurality of peaks and a plurality of troughs alternatively arranged with each other along a stacking direction of the staple-sheets;

a left locking saw-toothed portion formed in a left inner wall of the accommodating part and having a saw-toothed shape with a plurality of peaks and a plurality of troughs alternatively arranged with each other along the stacking direction;

a right return-preventing claw formed at a right end of the staple pressing member and configured to engage with the right locking saw-toothed portion; and a left return-preventing claw formed at a left end of the staple pressing member and configured to engage with the left locking saw-toothed portion, wherein a phase of the saw-toothed shape of the right locking saw-toothed portion is the same with a phase of the saw-toothed shape of the left locking saw-toothed portion, and wherein the right return-preventing claw is formed in a position shifted by ½ pitches of said saw-toothed shape in the stacking direction from the left return-preventing claw.

* * * * *